US005788418A

United States Patent [19]

Kuehn

[11] Patent Number: 5,788,418

[45] Date of Patent: Aug. 4, 1998

[54] DETACHABLE CONNECTOR FOR THE TRANSMISSION OF DRIVE ENERGY TO SUBMERSIBLE PILE DRIVERS, CUT-OFF EQUIPMENT OR SIMILAR WORK UNITS

[76] Inventor: Hans Kuehn, Tierparkallee 27, D-22527 Hamburg, Germany

[21] Appl. No.: 481,271

[22] PCT Filed: Jan. 3, 1994

[86] PCT No.: PCT/DE94/00003

§ 371 Date: Jul. 3, 1995

§ 102(e) Date: Jul. 3, 1995

[87] PCT Pub. No.: WO94/16153

PCT Pub. Date: Jul. 21, 1995

[30] Foreign Application Priority Data

Jan. 5, 1993 [DE] Germany ..... 43 00 075.4

[51] Int. Cl.[6] ..... E02D 7/10

[52] U.S. Cl. ..... 405/228; 405/232

[58] Field of Search ..... 405/228, 170, 405/169, 171; 173/132; 166/65.1, 338, 339, 342, 343

[56] References Cited

U.S. PATENT DOCUMENTS

| | | | |
|---|---|---|---|
| 3,314,240 | 4/1967 | Bardgette | 405/228 |
| 3,354,658 | 11/1967 | Leonardi | 61/69 |
| 3,520,358 | 7/1970 | Brooks et al. | 166/5 |
| 3,550,386 | 12/1970 | Ballinger | 61/69 |
| 3,608,651 | 9/1971 | Tindy et al. | 175/6 |
| 3,998,064 | 12/1976 | Jansz | 405/228 |
| 4,117,287 | 9/1978 | Walker et al. | 200/82 R |
| 4,157,287 | 6/1979 | Christenson | 204/180 R |
| 4,502,407 | 3/1985 | Stevens | 114/222 |
| 4,618,285 | 10/1986 | Ahlstone | 405/191 |
| 4,721,055 | 1/1988 | Pado | 114/331 |
| 4,817,734 | 4/1989 | Kuehn | 405/228 X |
| 4,818,149 | 4/1989 | Kuehn | 405/228 |
| 4,872,514 | 10/1989 | Kuehn | 405/228 X |
| 4,921,438 | 5/1990 | Godfrey et al. | 166/65.1 X |
| 5,052,941 | 10/1991 | Hernandez-Marti et al. | 166/65.1 X |
| 5,074,713 | 12/1991 | Salvi dos Reis | 405/169 |
| 5,092,711 | 3/1992 | Langner | 405/169 |
| 5,145,007 | 9/1992 | Dinkins | 166/65.1 X |
| 5,209,673 | 5/1993 | Mohn et al. | 166/65.1 X |
| 5,370,545 | 12/1994 | Laurent | 166/65.1 X |

FOREIGN PATENT DOCUMENTS

| | | | |
|---|---|---|---|
| 8301622 | 9/1983 | Netherlands | 405/228 |
| WO 92/20948 | 11/1992 | WIPO . | |

*Primary Examiner*—Dennis L. Taylor

*Attorney, Agent, or Firm*—Whyte Hirschboeck Dudek S.C.

[57] ABSTRACT

In order to transmit drive power to piling and cut-off devices (21) or the like usable under water from above the surface of the water to the underwater working device (21), long, heavy and expensive umbilical lines (27,20) with incorporated electric power leads or bunches of long, parallel hydraulic pipes are used which are permanently secured to the working device (21) and must therefore be handled in synchronism therewith, which is not always successful and can lead to damage. The proposal of the invention makes it possible to handle all the umbilical lines (20) and leads (23) including any power transmission means (25) incorporated therein separately from the working device (21) and to have a releasable plug connector (24, 26) at their lower end for direct or indirect connection to the working device (21). This avoids the risk of damage. The connection can be made at any time even outboard and under water.

21 Claims, 5 Drawing Sheets

10
9
14
13
15
3
11
18;16
20;20a
5
6
24
22
8
1
12
23
2
11;16
20
27;20
25
26
21
16 (18)
17
16
20;27
29
28
30

Fig. 6
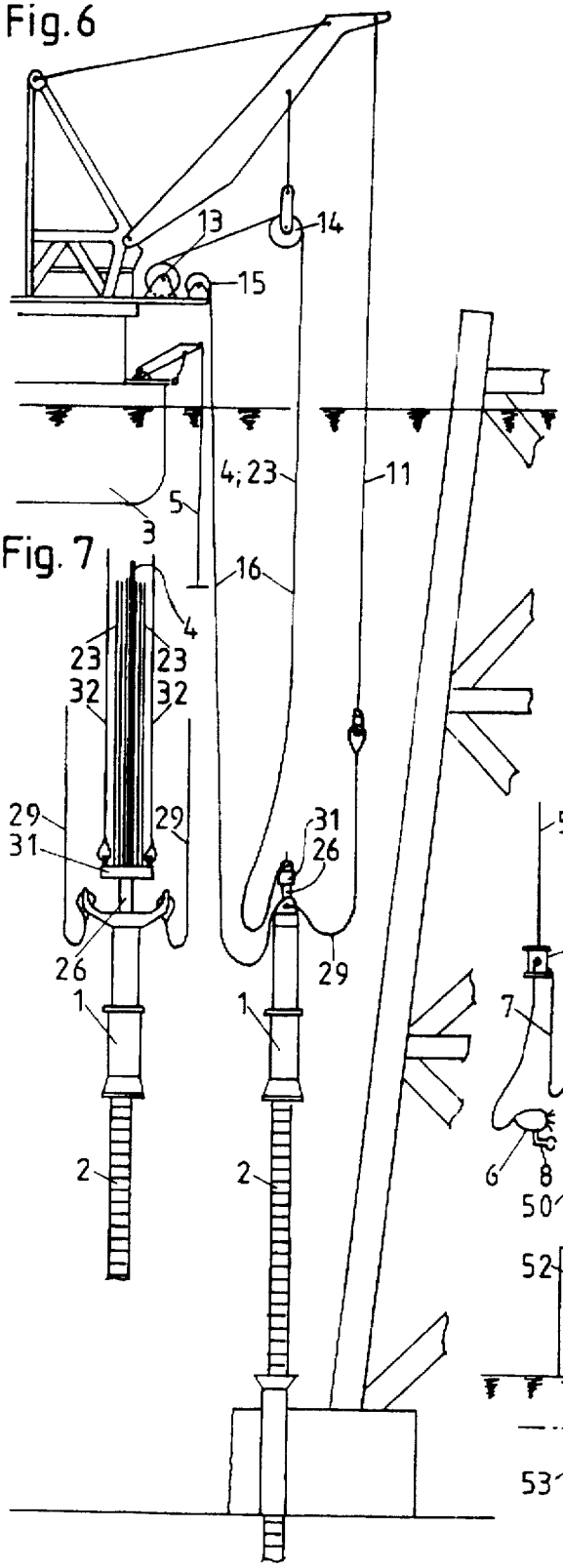
Fig. 7
Fig. 8
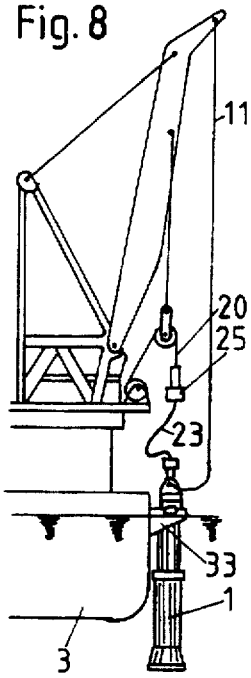
Fig. 9
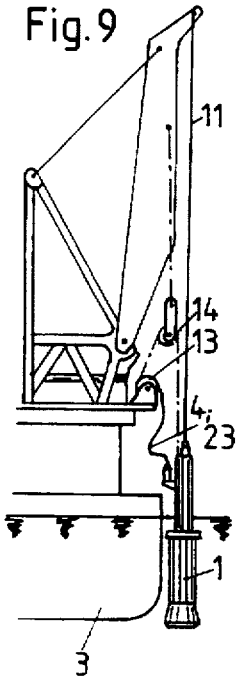
Fig. 10
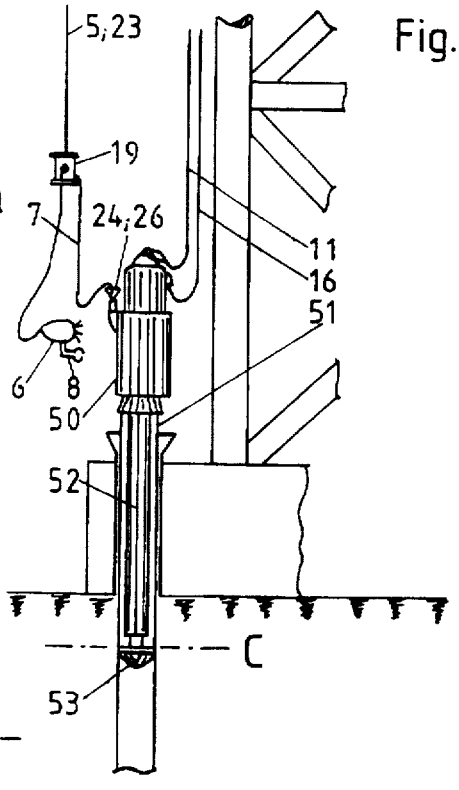

5/5

DETACHABLE CONNECTOR FOR THE TRANSMISSION OF DRIVE ENERGY TO SUBMERSIBLE PILE DRIVERS, CUT-OFF EQUIPMENT OR SIMILAR WORK UNITS

BACKGROUND OF THE INVENTION

This invention deals with a detachable connector for the transmission of drive energy to submersible pile drivers and cut-off equipment or similar equipment from above the water surface to the submerged work units.

For underwater pile driving on the sea floor, the pressure medium required for driving the equipment is supplied through a pressure medium circuit with long hoses from above the water surface to the work unit. Because of the flow resistance in the hoses, this is only feasible up to a certain water depth. Either the hose diameter must be increased or several hoses must be utilized next to each other, so that the flow resistance can be kept low and the pressure medium pumps can still cope with the additional pressure required to overcome it. Finally, the limits of feasibility, economy and also handling are reached.

In that case, a submersible drive unit is connected with the equipment and lowered together with it, supplying pressure medium through a short closed circuit, while, for the operation of the drive unit, electric energy is supplied by means of a long electric power cable from above the water surface with now much lower resistance, i. e. energy losses. For the operation of this kind of work unit/drive unit combination, at least one line for the supply of compressed air to the work unit is usually required in order to compensate for the outer pressure on enclosed empty spaces, and control lines for the control and monitoring of the work unit are also needed.

All these lines are gathered in one conduit only, the umbilical, so that only one line need be handled.

The umbilical is heavily reinforced for protection of the internal lines and for loading with tensile forces. It makes the greatest demands on manufacturing and can cost up to US $1400.00 per meter. It is substantially more expensive than a lightweight umbilical, as used for the operation with long hoses described in the beginning, which contains only control lines but no electric power cables. Depending on the equipment size, the energy to be transmitted and the operating depth, a long umbilical with accessories can therefore be more expensive than the pile driver itself. Price and fear of damage discourage its use.

Therefore, again and again, solutions have been tried using even longer and an even greater number of parallel hoses and lighter umbilicals; although these solutions appeared cheaper, failures have been more frequent because of high risk handling and ensuing higher costs. This is because the cost of one hour of downtime of a support ship can be as high as US $17,000.00, not counting the water pollution caused by the hose failure.

The costs for the heavy umbilical with winch, as well as for the pile driver/drive unit combination are driven even higher, because, in anticipation of failure of lines in the umbilical and/or one or more motor-pump units, the umbilical is equipped with a greater number of electric power cables and signal lines, or the drive unit is equipped with a greater number of, or larger, motor-pump units than required, since a quick remedy is currently not possible in the eventuality of a failure.

Moreover, the working speed of the equipment is based on standards which are common to conventional pile driving above water, which drives up the capacity of the work unit unnecessarily causing additional costs which are not commensurate with the derived benefit for underwater work.

The present situation of incurred downtime and damage costs of several million dollars has been tolerated for years. This is technically and economically unsatisfactory and this is also unsatisfactory because the expensive underwater equipment is needed only infrequently and only for short periods of time, i. e. it cannot be amortized quickly enough. However, the operation with long hoses in the appropriate applications is also still unsatisfactory and in need of improvement.

Similar problems occur with other work units, especially with underwater cut-off equipment which will be utilized more and more in future under similar conditions in the removal of drilling platforms.

SUMMARY OF THE INVENTION

The object of this invention is to provide a detachable connector for the transmission of energy to equipment of the aforementioned kind, which makes it possible, at lower equipment cost, to transmit drive energy more reliably and economically, to improve the ability to replace components and to utilize them more diversely. Therefore, its deployment is made more economical.

The means for attaining this object is for detachably transmitting electrical hydraulic energy from a drive unit to a submerged work unit. The drive unit is connected to a support ship, and the detachable underwater connector includes an underwater socket part and an underwater plug part. The underwater socket part attaches to a submerged underwater work unit having a wet connectable electric plug capable of transmitting electrical signals to the submerged work unit. The underwater socket part also has a pair of pressure medium channels in communication with a corresponding pair of pressure medium channels in the submerged work unit for transmitting hydraulic energy. The underwater plug part is connected to the drive unit and has a wet-connectable electrical socket capable of receiving one end of at least one electrical cable for the transmission of electrical signals. The other end of the electrical cable is connected to an electrical signal source on a support ship. The underwater plug part also has a pair of pressure medium channels in communication with a corresponding pair of pressure medium channels in the drive unit. The wet-connectable electric socket is capable of receiving the wet-connectable electric plug to transmit electrical signals from the support ship to the underwater work unit, and the pressure medium channels are capable of communicating hydraulic energy from the drive unit to the underwater work unit, when the underwater socket part is detachably coupled to the underwater plug part according to the invention.

This detachable connector makes it possible to circumvent the risks of damage during the handling of the work units by excluding from such handling those components which are required for the transmission of drive energy and deal with them separately. They can be connected with and detached from the work unit at any time, also outboard and underwater. This enables the design of lighter underwater drive units, quick inspection and repair, and quick interchange with cheaper components.

These advantages derive from the fact that the work unit can remain outboard and only energy transmitting means (umbilicals etc.) are taken aboard, with or without drive unit, or are separately hoisted up full speed, inspected and lowered again. The state of the art is such that these components can practically not be separated from the work unit outboard or at the work site. They have to be disassembled onboard. As a whole unit they can be hoisted up only slowly and lowered again especially slowly, if they have to be pressurized with air to compensate for the external water pressure.

Instead of an expensive umbilical one can also utilize a simple cable for the transmission of drive energy, depending on the method of operation, because handling is simpler and gentler. This simpler cable can be designed as a cheap lightweight umbilical without compressed air lines and without special reinforcement, but with integrated control cables, provided one does not choose a separate thin control cable or the signals are transmitted in another way.

On the other hand, for lower power requirements, one can also utilize a lightly reinforced cable or lightweight umbilical simultaneously as a lifting element to correspond with the smaller and lighter drive units.

Based on the improved ability to replace components, availability of excess power and capacity for standby purposes need not be considered in the equipment layout. Economical designs are possible. In the case of the drive unit, several electric-motor-pump-units can be combined into fewer or one single larger unit with lower total, yet appropriate power output, which is favorable from the points of view of construction, weight and handling.

The interconnection of components transmitting drive energy as electricity or pressure medium is achieved by wet connectable parts, possibly exposed to high water pressure, preferably by means of multi-channel single plug-type connectors. Before the operation begins, they are secured against pull-out and torque exerted by the electric motors either automatically by means of pressure medium or by other outside means.

The proposed solutions also improve the operation with long hoses from above the water surface. It is also possible to change over already existing underwater work units and installations partly or completely, as proposed.

The detachable connector according to the invention is economically usable up to practically unlimited water depth, and can be used with pile drivers, vibration-, cut-off equipment and other underwater work units.

Further variations of this detachable connector is described in the claims. Preferred application examples of the installation are described below in the corresponding drawings.

BRIEF DESCRIPTION OF THE DRAWINGS

FIG. 6 shows a schematic representation of a pile driver set on top of a foundation pile of a drilling platform and connected with the support ship by means of pressure medium lines.

FIG. 7 shows a side view of the pile driver according to FIG. 6.

FIG. 8 shows a schematic representation of a pile driver with drive unit hanging outboard at deck height.

FIG. 9 shows a representation, similar to FIG. 8, in a different equipment configuration.

FIG. 10 shows a schematic representation of cut-off equipment set on a foundation pile of an underwater structure.

DETAILED DESCRIPTION OF THE DRAWINGS

Figures 1, 2, 3, 4, 5:
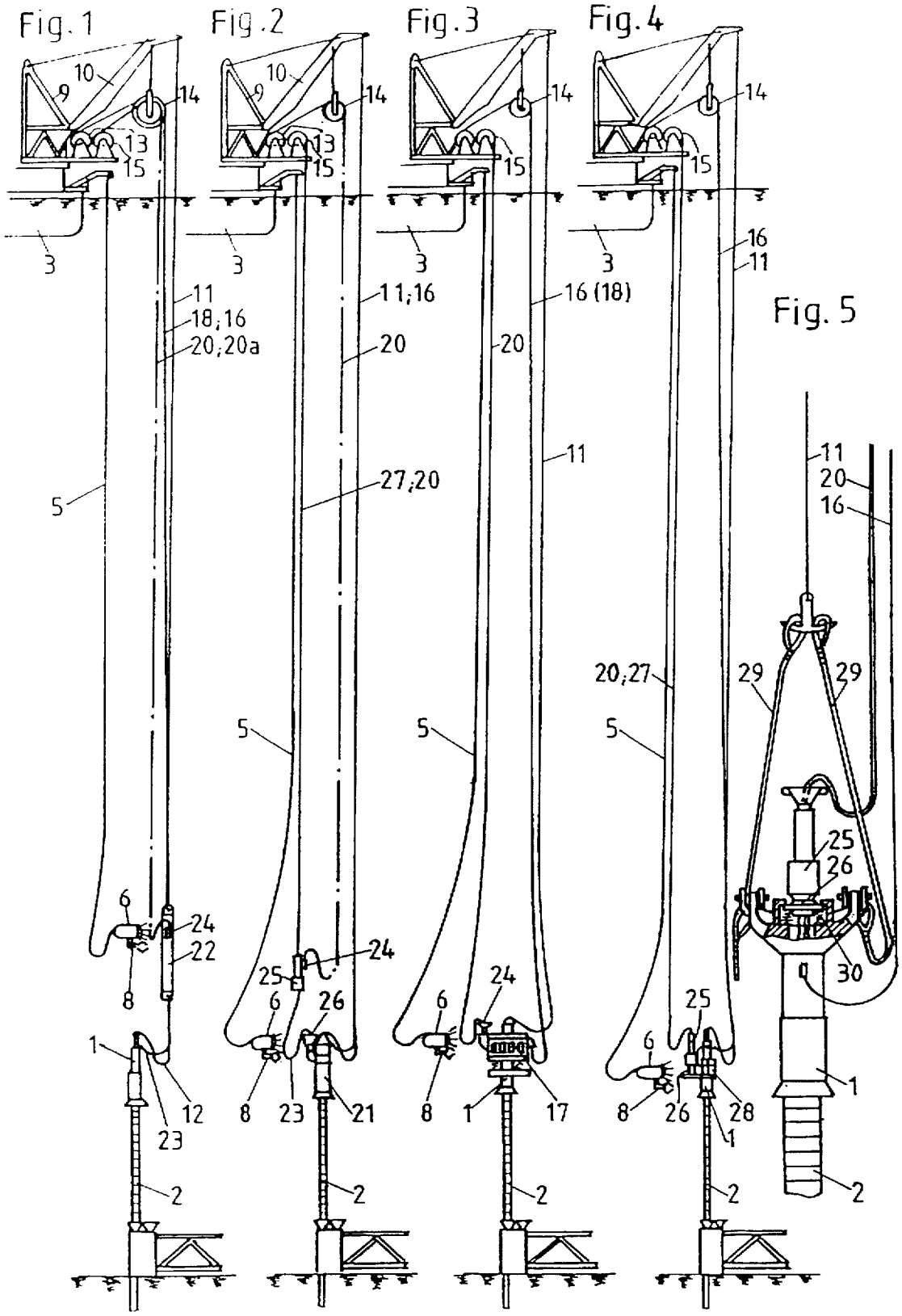
FIG. 1 shows schematically a pile driver set on top of a foundation pile of an underwater structure and conventionally connected with the support ship by way of a drive unit.
FIG. 2 shows a representation, similar to FIG. 1, of a vibration pile driver with a smaller, simplified drive unit.
FIG. 3 shows a representation, similar to FIGS. 1 and 2, with of a conventional drive unit installed directly on the pile driver.
FIG. 4 shows a representation, similar to FIG. 3, with a smaller, simplified drive unit.
FIG. 5 shows a schematic representation of a pile driver with a coaxial drive unit installed on it.

FIG. 1 shows a pile driver 1 free standing on top of the foundation pile 2 connected with the support ship 3 in the coventional manner. The pile driver 1 is lifted and lowered by the crane 9, boom 10, and lifting rope 11 together with the drive unit 22, which is connected by the additional lifting rope 12 with the pile driver 1. The umbilical 18, which connects support ship 3 by way of winch 13 and deviating roller 14 with the drive unit 22 for the supply of energy and compressed air or signals, must be moved in unison during all operations. Inevitably the same applies to the lines 23 which firmly interconnect pile driver 1 and work unit 22, and which are endangered together with the expensive umbilical 18.

The endangering is minimized by an umbilical 20 supported by a winch 15, and extending to the drive unit 22 where it can be plugged in and unplugged at any time, because the electric power cable and control line plug connection 24 (similar to FIG. 13) is made only after the endangering action, but at the latest underwater when the pile driver 1 is already set on the foundation pile 2. In addition, the umbilical 20 is cheaper because it contains only electric power cables and control lines. In addition to the lifting rope 11, instead of the umbilical 18, only the compressed air line 16, which is replaceable at little cost, continues to be connected with the drive unit 22, and from there with the pile driver 1, because compressed air supply is required from the beginning of the dive. This gentler handling even makes it possible to install a still more favorable electric power line 20*a* and a separate control line instead of the umbilical 20.

The number of plug connections 24 depends on their transmission capacity and the energy requirement. The plug connections are made with the robot tool 8 of the remote controlled underwater vehicle 6 which is connected with the support ship 3 by means of line 5.

The vibration pile driver 21 shown in FIG. 2 is connected, in contrast to FIG. 1, with a smaller, simplified and separate drive unit 25. As in FIG. 1, the energy supply of the vibration pile driver 21 is provided from the support ship 3 by way of the component winch train 13, deviating roller 14, umbilical 20, electric power line and control line plug connection 24, drive unit 25 and supply line 23, which is detachably connected with vibration pile driver 21 by means of the pressure medium and control line plug connection 26.

The supply line 23 and the drive unit 25 with umbilical 20, that is the whole train of energy transmitting components, can therefore be handled singly and gently according to its requirements.

Now the drive unit 25 no longer acts as a load carrying element between lifting ropes 11 and 12, as shown in FIG. 1. The lifting rope 12 is therefore not required. The drive unit 25 can have a lighter weight design because it is not required to carry load. It can now also be suspended from an appropriate tension carrying umbilical 20, thereby eliminating the lifting rope 27.

The plugging in operations are carried out with the help of underwater vehicle 6.

In FIG. 3, the pile driver 1 is powered by a directly mounted, conventional drive unit 17 by way of a small internal closed pressure medium circuit (not shown).

The energy supply is optimized, similar to FIG. 1, in that the expensive umbilical 18 is divided up into the compressed air line 16 and the lifting rope 11 carrying the pile driver 1/drive unit 17 combination, with both lines being handled simultaneously, and the umbilical 20, handled separately, now still carrying only electric power and control lines which are detachably connected to the drive unit 17 by means of the plug connection 24.

Apart from the cost savings derived from dividing up the umbilical 18 and its lowered risk of damage, the advantage of its improved interchange possibility remains, as in FIG. 1.

In FIG. 4, a smaller, simplified drive unit 25 is directly connected with pile driver 1. In contrast to the variation shown in FIG. 3, the drive unit 25 is connected as a whole with the pile driver 1 by means of a detachable pressure medium and control line plug connection 26 (see explanations for FIG. 12 and 15). The unplugging of plug connection 26 is affected by pulling with the lifting rope 27 or with the umbilical 20 or cable 20*a*. As required one or several drive units 25 can be arranged around the pile driver and connected with it. An imbalance is compensated for by a counterweight 28.

In FIG. 5, the drive unit 25 is connected, in contrast to FIG. 4, directly and coaxially to the upper portion of the pile driver 1. This is why two ropes 29 are utilized which are connected at their lower ends to the sides of the upper portion of pile driver 1, and at their upper ends to the lifting rope 11, without contacting the drive unit. Compressed air is supplied by means of line 16. The drive unit 25 is connected with a detachable plug connection 26, as described in FIG. 4. It is supported on the pile driver by means of a spring 30 which cushions shocks. This arrangement is favorable for symmetry reasons.

FIG. 6 shows a pile driver 1 which is connected with the support ship 3 by means of long pressure medium lines 23 next to a control line 4, by way of the deviating roller 14 and the winch 13. The pile driver 1 is connected with the support ship 3 for the supply of compressed air by means of line 16 by way of the winch 15, and for lifting and lowering by means of lifting ropes 11 and 29.

For connecting lines 23 with the pile driver 1, a detachable pressure medium and control line plug connection 26 with distributor piece 31 is provided. The desired gentle handling is provided by the possibility of separating the lines 23 and the control cable 4 from the pile driver 1.

In FIG. 7 are shown, as a side view of FIG. 6, several parallel pressure medium lines 23 and a control line 4 in the center, all of which terminate at the distributor piece 31. This line/cable bundle is directly connected with the support ship 3 or with an intermediate underwater drive unit. The large number of hoses 23 with small diameter are used in order to avoid using a very expensive type of hose with corresponding large diameter for the feed and return lines. As an alternative, standard hoses in commercially available short lengths are coupled together. But since the latter do not measure up to the rough handling and since the many couplings often leak, trouble arises, and frequently in the vicinity of the pile driver. To remedy this difficulty, the pile driver 1, together with the firmly affixed hoses, has to be lifted up in order to exchange the damaged hose piece outboard, or the pile driver has to be lifted onboard and laid down on deck.

According to the invention the repair of such damage is simpler and achieved with greater certainty, because the lightweight hose bundle can be separated at the plug connection 26 and lifted up separately by means of the lifting ropes 32 at any time, while the work unit remains underwater or outboard. See FIGS. 8 and 9.

FIG. 8 shows a pile driver 1 held outboard in a fixture 33. The lines are connected or disconnected during the short period of time at the ship's side after the pile driver has been lifted from the deck and swung outboard, or after it has been lifted up from below. The latter is important if the plug connection is equipped with a lock which has to be actuated by remote control from an underwater vehicle, and if the vehicle is defective, so that the separation cannot be affected underwater. This is done here so that the sensitive parts can be separated before the dangerous placement on deck.

The arrangement shown in FIG. 9 corresponds to that of FIG. 8 except that here the lines 4 and 23, feeding directly from the winch 13 or alternatively by way of the deviating roller 14, are connected to the side of the freely and outboardly hanging pile driver 1 which is easily accessible from the ship's side in order to make use of the invention's advantages.

Corresponding with the diverse application possibilities, FIG. 10 shows underwater cut-off equipment 50 which is placed on top of a driven foundation pipe pile 51 and whose shaft 52 with the cut-off tool 53 protrudes into it, so that it can be cut off below the sea floor in section C. The cut-off equipment 50 is driven by an underwater drive unit, which is powered electrically or hydraulically from above the water surface. It is supplied conventionally, depending on type of drive, either by means of an umbilical or long pressure medium lines 23 including control line.

In both cases, according to the invention the cut-off equipment 50 is first handled without energy supply lines. They are connected later. Since cut-off equipment consumes very little power, equipment needed for observation such as an underwater vehicle 6 with television camera including lifting equipment can be utilized at low cost. Thus, electric energy for the electric-hydraulic drive unit on the cut-off equipment 50 and signals are preferably supplied to the cut-off equipment 50 by means of the umbilical 5, the launch cage 19 for the underwater vehicle 6 and one or two connection lines 7 connected by means of an electric plug connection 24.

If long pressure medium lines 23 supply the drive energy from the support ship 3 to the cut-off equipment 50, then these follow the same supply path. They terminate in a pressure medium and control line plug connection 26 at the cut-off equipment 50.

Furthermore the cut-off equipment 50 is connected with the support ship 3 by means of the lifting line 11 and the supply line 16 for compressed air or cutting medium.

In addition to the advantages explained above, there are those of utilizing existing components.

Figure 11:
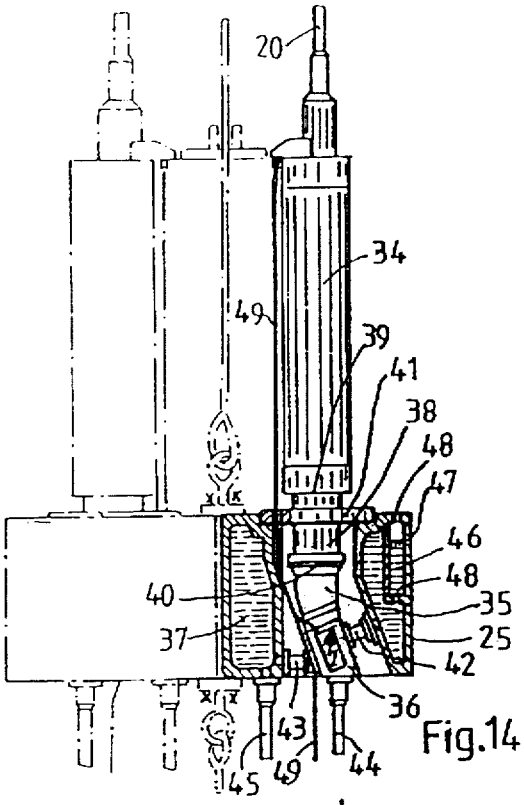
FIG. 11 shows a schematic representation of a smaller, simplified drive unit.

FIG. 11 shows a lightweight drive unit 25. It consists of an underwater electric motor 34, a pressure medium pump 35 and a pressure medium tank 37. These modular components are joined together by means of a coupling piece 38 to establish a drive unit. The electric motor 34 is connected with its pedestal 39 to the upper part, the pressure medium pump 35 with its flange 40 to the lower end and the pressure medium tank 37 at the flange 41 of coupling piece 38. The flange 41 is shimmed with a slightly elastic and flexible material in order to dampen shocks to the electric motor 34 and to bridge machining tolerances between connecting surfaces for lines 12 and 13 when, instead of these, couplings with machined surfaces are used to ensure leak tight connections. See FIGS. 12, 14, 15 and 17.

A valve block 36 is attached to the pressure medium pump for the required operating controls. Pressure medium flows from the flexible connection 42 through valve block 36 to pressure medium pump 35 and then flows pressureless in short circuit loop either completely or partially back to the pressure medium tank 37 through flexible connection 43, or flows either completely or partially through connection 44 to the work unit and back to pressure medium tank through connection 45. A pressure equalization cylinder 46 with floating piston 47 communicates through openings 48 with the external water on the one side and with the pressure medium on the other. It ensures pressure is equalized between external water and pressure medium tank.

The energy is supplied by means of the umbilical 20 which is, because of the lightweight drive unit 25, simultaneously the lifting element. The control line 49, exiting from the umbilical 20 or coming separately from above, continues to the work unit.

By way of dashed lines it is shown how two drive units may be joined in a simple manner.

Figure 12:
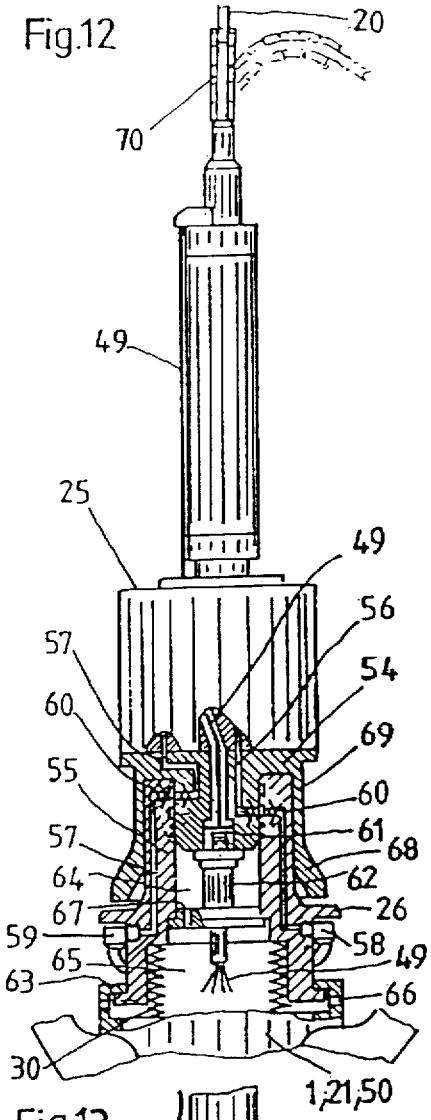
FIG. 12 shows a drive unit according to FIG. 11 with a plug connection connected coaxially on the top end of a pile driver or cut-off equipment.

In FIG. 12, the drive unit 25 is directly and coaxially connected to the top of the work unit (1, 21 or 50) by means of a pressure medium and control line plug connection 26.

The plug connection 26 consists of the plug part 54 which is fastened to the drive unit and the socket part 55. The plug part contains pressure medium channels 56 and 57 which continue on in socket part 55 and terminate in hose connection 58 and 59 which feed pressure medium into and return the same from the work unit. The channels have check valves 60 which prevent oil from leaking out and water from entering into the systems when unplugged.

The control lines 49 are connected in the plug part 54 to a coaxial, wet-connectable electric socket 61, whose plug 62 is located in socket part 55, and which connects control lines 49 with the work unit. The support of socket 61 is preferably elastically displaceable in the transverse direction in order to avoid problems caused by off-centering of the connecting parts 54 and 55.

The electric plug connection 61/62 is made simultaneously with the pressure medium connection 54/55. For work units 1, 21, which are subject to vibrations, the socket part 55 may be mounted in a flange ring 63 and spring loaded with a spring 30. The plug connection is plugged in by the weight of the drive unit. As spaces 64, 65 become smaller during plugging in, or fluctuate in size because of spring action, the displaced water escapes through openings 66 and 67.

In order to avoid damage to the sealing surface on plug part 54, a protective skirt 69 is provided which has a large guide cone 68 on its lower end facilitating plugging parts 54 and 55 together.

The lifting element is the umbilical 20 itself which is protected against excessive bending by a bending resistant sleeve 70. It must be capable of unplugging plug part 54 by overcoming the small forces due to retentive connections. Otherwise a lifting rope will be used.

Figure 13:
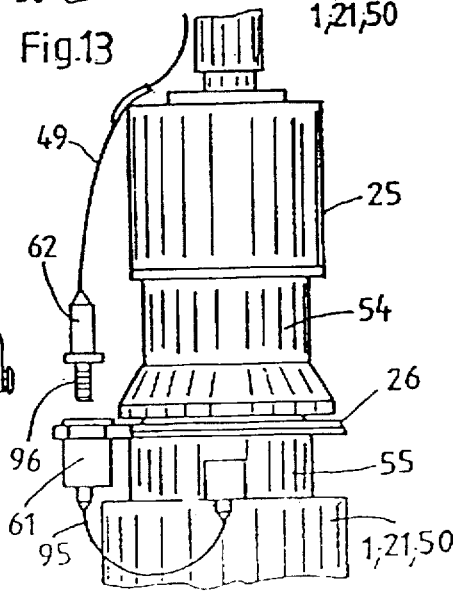
FIG. 13 shows a partial view of FIG. 12 with an electric plug connection external to the plug connection connecting the drive unit.

FIG. 13 shows an embodiment according to FIG. 12, where the electric socket part 61 with plug 62 for control cable 49 is relocated to the outside and is connected to the work unit 1, 21, 50 by means of line 95, thereby simplifying the interior of plug connection 26. Since parts 61 and 62 are connected to spring loaded socket part 55, they are also spring loaded.

The coaxial cylindrical pin of plug part 62 has as many ring contacts 96 as there are signals to be transmitted, provided there are no facilities for information processing and transmission on work unit 1, 21, 50 that allow several different signals to be transmitted through a single ring contact 96.

If control line 49 contains a compressed air line, then compressed air can be transmitted through the hollow plug part 62 and a correspondingly designed socket 61 to the work unit. In this case check valves 60 are to be provided in both parts as described in FIG. 12.

Plug 62 is plugged in by the underwater vehicle 6, as explained under FIG. 2, and unplugged together with the drive unit 25 during unplugging of plug connection 26 by pulling on the umbilical. If required, the plug connection parts 61/62 can be locked together, e.g. similar to FIG. 15 and FIG. 16.

Figure 14:
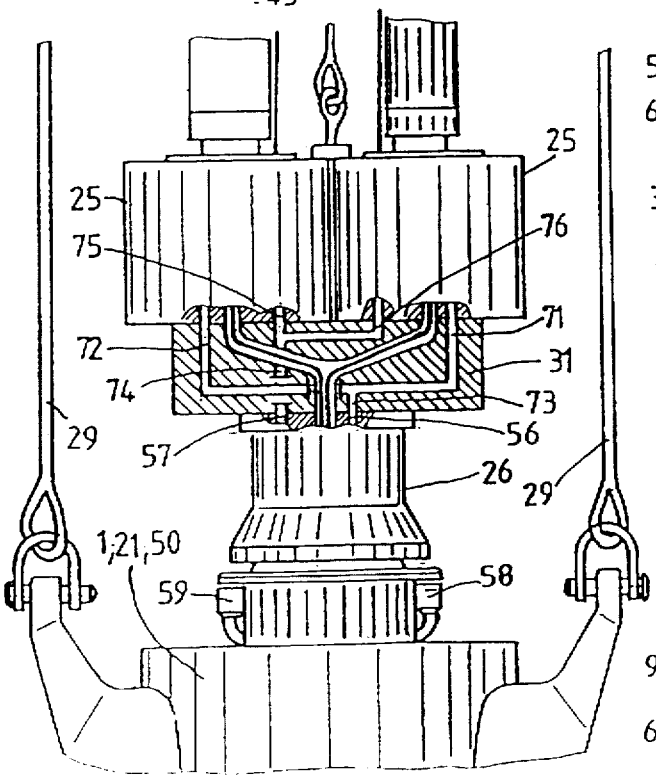
FIG. 14 shows a partial view of a drive unit composed of several modular drive units set on a work unit, as in FIG. 12.

In FIG. 14 two interconnected drive units 25 are connected to the top of the work unit (1, 21, 50) by means of a distributor piece 31 and the pressure medium and control line plug connection 26. The distributor piece combines pressure medium coming from the pressure medium pumps of drive units 25 in channels 71 and 72 into channel 73 and feeds it through channel 56 and through plug connection 26 to the work unit (1, 21, 50). Pressure medium coming from the latter through channel 57 to channel 74 and distributed to channels 75 and 76 is returned to the pressure medium tanks of the two drive units 25.

Figure 15:
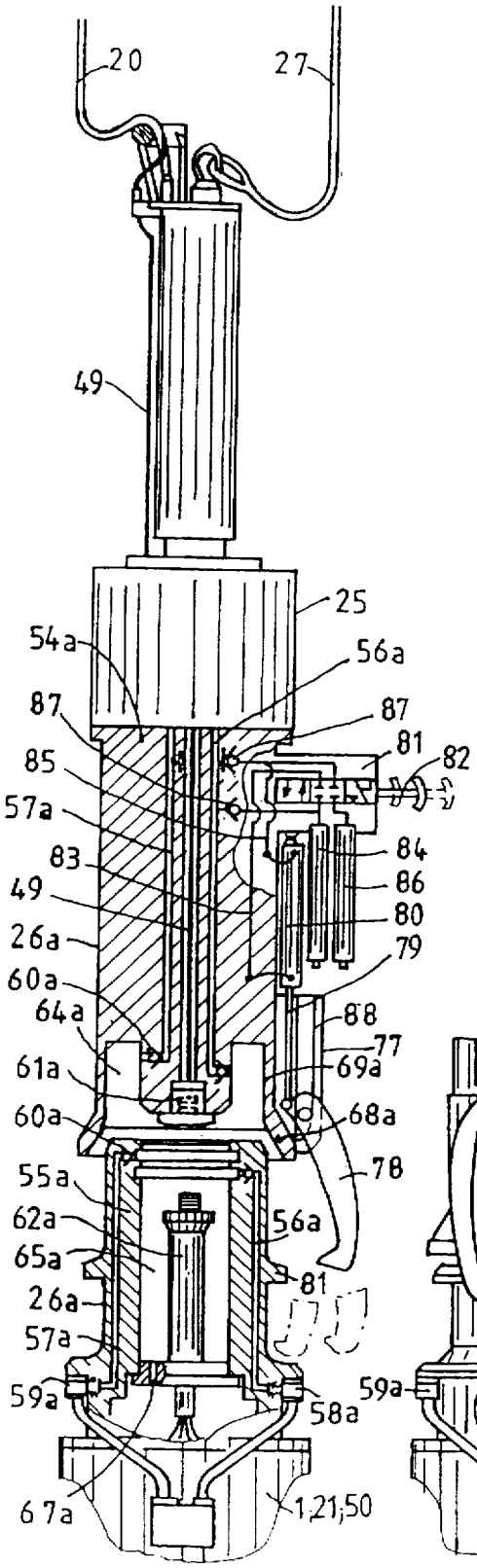
FIG. 15 shows a representation, similar to FIG. 12, with a lockable plug connection.

FIG. 15 shows, in contrast to FIG. 12, a pressure medium and control line plug connection **26*a* with a locking device 77 which simultaneously serves as a pulling device assisting in securely plugging the two parts together. The parts 54*a* to 69*a* of plug connection 26*a* correspond functionally with those of plug connection 26 of FIG. 12**. They are therefore not described again here.

The plug connection **26*a* is shown just before the plugging in operation. The socket part 55*a* is already engaging the guide cone 68*a* of plug part 54*a* and the locking hook 78 is about to swivel and hook on below shoulder 81 as piston rod 79 of cylinder 80 is retracted. As piston rod is retracted further, parts 54*a* and 55*a*, and simultaneously electric socket parts 61***a* and 62*a*, are pulled together by the pulling action of the locking hook which rides in guide 88, and which finally firmly tensions them together unless the weight of the drive unit 1 is sufficient to effect this by itself. Since the contact areas are pressed together, any torque created during starting and running of the electric motor is absorbed by friction in the contact areas.

The locking mechanism 77 is actuated by control valve 81 whose control rod 82 is manipulated underwater by underwater vehicle 6 or other suitable means. In order to retract piston rod 79, pressure medium is sent from the high pressure accumulator 84 to the lower chamber of cylinder 80 through line 83, while simultaneously the displaced hydraulic fluid from the upper chamber of cylinder 80 is sent through line 85 to the low pressure accumulator 86.

Unlocking occurs through a spring (not shown), which is located, e.g. in the upper chamber of cylinder 80, and which pushes the piston rod in the initial position; simultaneously lines 83 and 85 are connected with the low pressure accumulator 86 transfering the required pressure medium.

If there is insufficient pressure medium in accumulators 84 and 86, i.e. if pressure falls below the lower threshold, it is replenished through check valves 87 from the closed pressure medium circuit. Conversely, an excess of pressure medium is released from the accumulator 84 or 86 to the pressure medium circuit through pressure relief valves (not shown).

The check valves 87 are placed in the closed pressure medium circuit of the work unit (1, 21, 50), as functionally required: For the high pressure accumulator 84 in pressure channel 56*a*, and for the low pressure accumulator 86 in return channel 57*a*.

The drive energy is supplied by means of the umbilical 20 or separate electric power cables and control lines.

Figure 16:
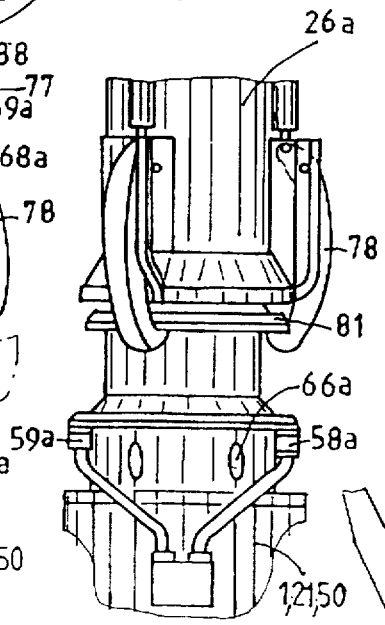
FIG. 16 shows a partial view of a representation according to FIG. 15 with a locked plug connection.

If required, a spring 30 as shown in FIG. 12 can be included in this plug connection also. FIG. 16 shows a partial view of plug connection 26*a* with locking hooks 78 of which there are three distributed on the circumference to ensure uniform pull and clamping force, and also friction force to counteract torque created during starting and running of the underwater electric motors.

Figure 17:
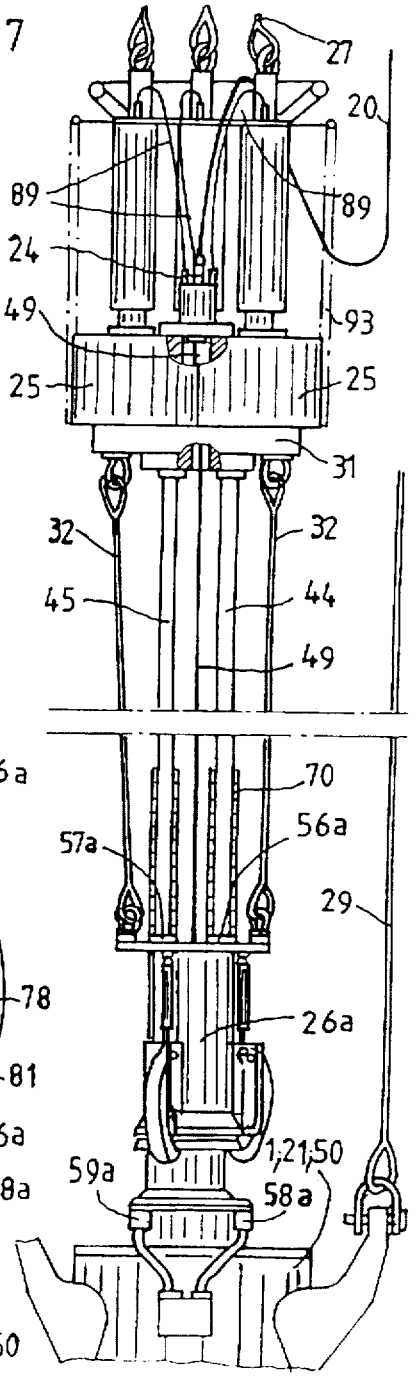
FIG. 17 shows a schematic representation of three interconnected drive units connected with the underwater work unit by means of lines.

The three drive units shown in FIG. 17, interconnected to produce greater drive energy, are detachably connected with the work unit 1, 21, 50 by means of a distributor piece 31, as explained for FIG. 14, pressure medium lines 44 and 45, control line 49 and plug connection 26*a*. The pressure medium lines 44 and 45 supply and return, respectively, pressure medium to and from work unit 1, 21, 50 by means of channels 56*a*, 58*a* and 57*a*, 59*a*, respectively.

Electrical energy is supplied by the umbilical 20 to the electric power and control line plug connection 24, from where it is distributed to the electric motor of each drive unit 25 by means of lines 89. The control line 49 also branches off from the plug connection 24.

The drive units 25 with plug connection 26*a* are raised and lowered by lifting ropes 32 and 27 and, after unplugging plug connection 26*a*, can be handled as one single assembly, separately from the work unit 1, 21, 50.

The advantages of this configuration correspond to those described above in reference to FIGS. 2, 7 and 8.

Figure 18:
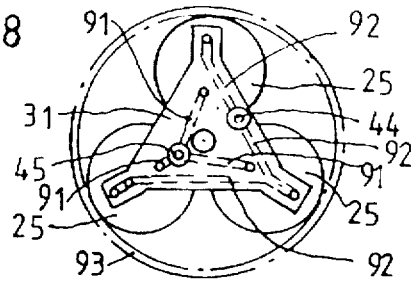
FIG. 18 shows the drive units according to FIG. 17 from below.

FIG. 18 shows how channels 92 and 91 are arranged in distributor piece 31, collecting pressure medium from drive units 25 and conveying it to connection 44, or distributing returning pressure medium from connection 45 to drive units 25. Also, channels 91, by virtue of interconnecting and connecting with pressure medium tanks 37 of drive units 25, ensure that pressure medium tanks are communicating pressure medium with each other.

Additionally, each individual drive unit 25 is connected to the distributor piece 31. It firmly connects them to each other to establish a single load bearing construction unit. If extended outwardly, it can also serve as the base for the protective skirt 93 indicated by dashed lines.

The distributor piece 31 contributes significantly to the desired light weight and economic design of the detachable connector.

Figure 19:
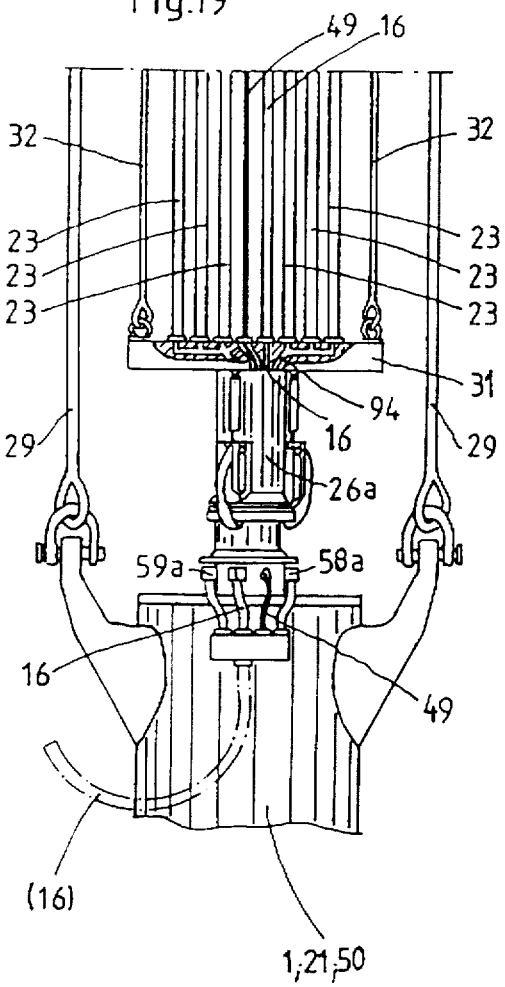
FIG. 19 shows a detailed partial view of the pressure medium hose connection with the pile driver according to FIG. 7.

In contrast to FIGS. 13 and 16 where the drive units 25 are directly connected with distributor piece 31, FIG. 19 shows in more detail an application according to FIGS. 6 and 7 where a plurality of pressure medium lines 23 are connected with channels 44 and 45 which continue on through plug connection 26*a* to work unit 1, 21, 50 by way of connections 58*a* and 59*a*.

The compressed air line 16 is separate, unless the plug connection 26*a* is to be plugged in or unplugged outboard but not underwater. In this case the compressed air line 16 is connected as shown and additional channels (not shown) are provided inside the plug connection 26*a*.

The distributor piece 31 can, of course, also be arranged at the upper end of lines 4 and 23, in order to provide an interface for equipment components suitable for the particular operation at hand. The advantages of this application are already described above in reference to FIGS. 6 and 7.

Figure 20:
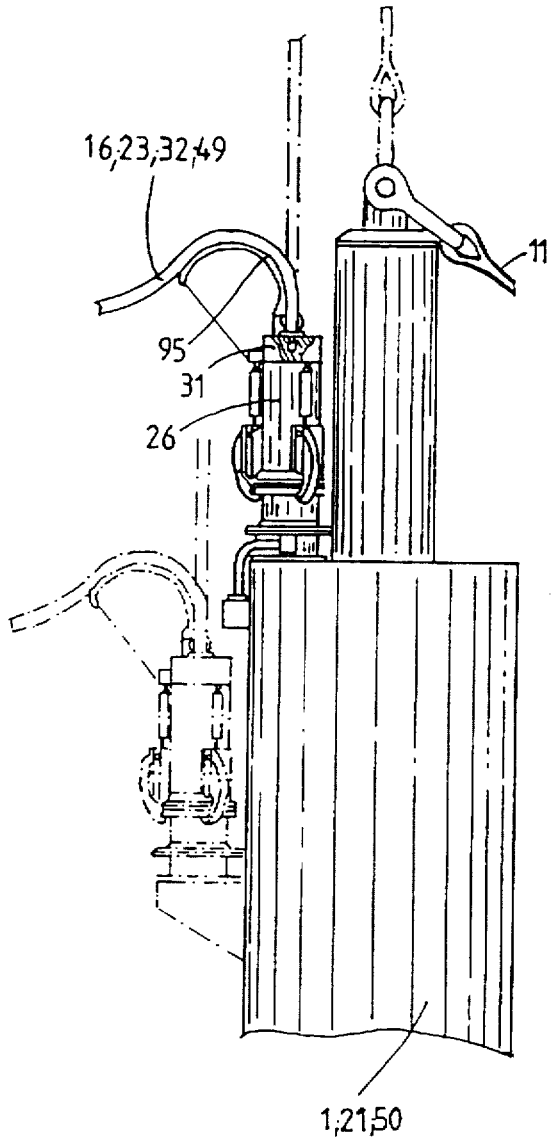
FIG. 20 shows a magnified detailed partial view of the top portion of pile driver similar to FIG. 9.

FIG. 20 shows a centrally connected lifting rope 11 and distributor piece 31/plug connection 26*a* combination connected on the side of work unit 1, 21, 50 as in FIG. 9, and the distributor piece 31 in connection with lines 16, 23 and 49 according to FIG. 19. The lines and lifting ropes 32 are laid down on a device 95 which safeguards against excessive bending and which is affixed to distributor piece 31.

An alternative possibility for affixing the parts combination is shown by way of dashed lines.

The advantages according to this invention can be favorably applied to the present diverse deployment practice of underwater work units. They shall be useful for the already anticipated deployment of similar equipment.

We claim:

1. A detachable underwater connector for detachably transmitting electrical and hydraulic energy from a drive unit to a submerged work unit, wherein the drive unit is fixedly connected to a support ship afloat on a body of water, the detachable underwater connector comprising:

an underwater socket part attached to a submerged underwater work unit having a wet-connectable electric plug capable of transmitting electrical energy to the submerged work unit, the underwater socket part also having a pair of pressure medium channels in communication with a corresponding pair of pressure medium channels in the submerged work unit; and an underwater plug part connected to the drive unit having a wet-connectable electric socket capable of receiving one end of at least one electrical cable for the transmission of electrical energy, wherein another end of the electrical cable is connected to an electrical source on a support ship, the underwater plug part also having a pair of pressure medium channels in communication with a corresponding pair of pressure medium channels in the drive unit; and wherein the wet-connectable electric socket is capable of receiving the wet-connectable electric plug to transmit electrical energy from the support ship to the underwater work unit, and the pressure medium channels are capable of communicating hydraulic energy from the drive unit to the underwater work unit, when the underwater socket part is detachably coupled to the underwater plug part.

2. The detachable underwater connector of claim 1 wherein the drive unit is situated on the support ship and further comprises at least one pair of hydraulic lines for the transmission of hydraulic energy, each hydraulic line having a top end and a bottom end, the pair of hydraulic lines comprising a supply hydraulic line having its top end connected to the drive unit on the support ship and a return hydraulic line having its top end connected to a hydraulic fluid return for the drive unit on the support ship and each hydraulic line bottom end connected to the detachable underwater connector.

3. The detachable underwater connector of claim 1 wherein the drive unit is situated underwater and a supply line remotely connects the drive unit to the underwater work unit by way of the detachable underwater connector.

4. The detachable underwater connector of claim 1 wherein the drive unit is attached to and mounted on the underwater socket part of the detachable underwater connector.

5. The detachable underwater connector of claim 1 wherein each pressure medium channel of the underwater plug part has a check valve therein.

6. The detachable underwater connector of claim 1 further compromising a lifting umbilical and wherein the detachable underwater connector is detachably coupled and sealed by the weight of the underwater plug part descending over the underwater socket part, and is detachable by exerting a lifting force on the lifting umbilical.

7. The detachable underwater connector of claim 1 further compromising a locking device having a locking hook pivotally mounted to the underwater plug part and engageable with a shoulder protruding from the underwater plug part, wherein the locking device is actuated by a control valve.

8. The detachable underwater connector of claim 7 wherein the control valve comprises a control rod to actuate a pressure cylinder for retracting a piston rod to pivotally swivel the locking hook of the underwater plug part to the shoulder of the underwater socket part.

9. The detachable underwater connector of claim 8 wherein the pressure cylinder is pressurized by one of a high gas pressure medium accumulator and a low gas pressure medium accumulator.

10. The detachable underwater connector of claim 1 further comprising a distributor piece having an upper end and a lower end, the distributor piece lower end attached to an upper end of the underwater plug part, and the distributor piece upper end connected to two interconnected drive units, whereby the distributor piece combines and distributes pressure medium from the two interconnected drive units to the underwater work unit.

11. The detachable underwater connector of claim 1 wherein the underwater socket part and the underwater plug part each further comprises an additional channel for communicating compressed air therethrough.

12. The detachable underwater connector of claim 7 further comprising an outboard fixture mounted to the support ship for receiving the underwater work unit and allowing above water disengagement of the locking device prior to placement of the work unit on a deck of the support ship.

13. The detachable underwater connector of claim 1 wherein the underwater socket part is mounted within a flange ring having a biasing spring therein to outwardly bias the underwater socket part to compensate for vibrations from the work unit.

14. The detachable underwater connector of claim 1 wherein at least one water escape opening is provided in the underwater socket part communicating between an interior of the underwater connector and the exterior of the underwater connector to displace water as the underwater plug part is coupled to the underwater socket part.

15. The detachable underwater connector of claim 1 further comprising a protective skirt placed about the underwater plug part and having a guide cone at its lower end to facilitate the coupling of the underwater plug part to the underwater socket part.

16. The detachable underwater connector of claim 1 wherein the wet-connectable electric plug and socket are positioned on the exterior of the detachable underwater connector.

17. The detachable underwater connector of claim 1 wherein the wet-connectable electric plug and socket have a plurality of ring contacts corresponding to a number of desired signals to be transmitted.

18. The detachable underwater connector of claim 1 further comprising a remote controlled underwater vehicle having a robot tool to guide the coupling of the underwater plug part to the underwater socket part.

19. The detachable underwater connector of claim 18 wherein the underwater vehicle further comprises a camera and communication system to assist in the coupling and decoupling of the detachable underwater connector.

20. The detachable underwater connector of claim 1 wherein the underwater socket part and the underwater plug part are wet-connectable.

21. A method of transmitting drive energy from a support ship to an underwater work unit comprising the steps of:

connecting an umbilical between an electrical source on a support ship and a submersible drive unit for transmitting electrical power to the submersible drive unit;

assembling a hydraulic plug and an electric socket to the submersible drive unit for transmitting hydraulic and electrical energy to an underwater work unit;

lowering the umbilical and drive unit assembly, apart from the underwater work unit, from the support ship to the underwater work unit;

positioning and connecting the umbilical and drive unit assembly to the underwater work unit, wherein the hydraulic plug and the electric socket attached to the drive unit are aligned with a hydraulic socket and an electric plug on the underwater work unit by engaging a guide cone on the hydraulic plug for facilitating the connection; and further lowering the umbilical and drive unit assembly until a connection is complete between the drive unit and the underwater work unit such that the connection can withstand high water pressure.

* * * * *